US008544601B2

(12) United States Patent
Chae et al.

(10) Patent No.: US 8,544,601 B2
(45) Date of Patent: Oct. 1, 2013

(54) SOUND-ABSORBING NOISE BARRIER

(75) Inventors: Kyoung Myoung Chae, Cheongju-si (KR); Kangwoo Kim, Goyang-si (KR); Dongjin Kim, Daejeon (KR); Jae-Youl Joung, Daejeon (KR); Yunhwan Hwang, Yongin-si (KR)

(73) Assignee: LG Hausys, Ltd., Seoul (KR)

( * ) Notice: Subject to any disclaimer, the term of this patent is extended or adjusted under 35 U.S.C. 154(b) by 40 days.

(21) Appl. No.: 13/375,353

(22) PCT Filed: Jun. 7, 2010

(86) PCT No.: PCT/KR2010/003623

§ 371 (c)(1),
(2), (4) Date: Nov. 30, 2011

(87) PCT Pub. No.: WO2010/147324

PCT Pub. Date: Dec. 23, 2010

(65) Prior Publication Data

US 2012/0067665 A1 Mar. 22, 2012

(30) Foreign Application Priority Data

Jun. 19, 2009 (KR) ..... 10-2009-0055163

(51) Int. Cl.
*E04B 1/82* (2006.01)
*E04B 2/02* (2006.01)
*G10K 11/00* (2006.01)

(52) U.S. Cl.
USPC ..... 181/293; 181/210; 181/290

(58) Field of Classification Search
USPC ..... 181/293, 210
See application file for complete search history.

(56) References Cited

U.S. PATENT DOCUMENTS

| | | | | | |
|---|---|---|---|---|---|
| 4,064,960 | A | * | 12/1977 | Murakami | 181/210 |
| 4,330,046 | A | * | 5/1982 | Lerner et al. | 181/210 |
| 4,355,678 | A | * | 10/1982 | Romano | 160/332 |
| 4,838,524 | A | * | 6/1989 | McKeown et al. | 256/24 |
| 5,009,043 | A | * | 4/1991 | Kurrasch | 52/145 |
| 5,031,721 | A | * | 7/1991 | Barden et al. | 181/210 |
| 5,268,540 | A | * | 12/1993 | Rex | 181/210 |

FOREIGN PATENT DOCUMENTS

| | | | |
|---|---|---|---|
| EP | 1892452 | A1 * | 2/2008 |
| JP | 11-104898 | A | 4/1999 |
| JP | 2004-232262 | A | 8/2004 |

(Continued)

*Primary Examiner* — David Warren
*Assistant Examiner* — Christina Russell
(74) *Attorney, Agent, or Firm* — Nath, Goldberg & Meyer; Jerald L. Meyer; Stanley N. Protigal

(57) ABSTRACT

A sound-absorbing noise barrier, more specifically to one comprising: a main body which has a front surface and a rear surface and extends horizontally and in which a space is formed between the front surface and the rear surface; and a sound-absorbing material which is accommodated in the space of the main body and is disposed at a distance away from the front surface and the rear surface respectively, wherein the front surface of the main body is formed with vertically oriented alternating projections and recesses and is formed with a plurality of sound-absorbing holes, and the overall cross-sectional area of the sound-absorbing holes is at least 20% of the cross-sectional area of the front surface. The sound-absorbing noise barrier of the present invention can be variously employed in construction and industrial products, has good sound-absorbing characteristics across a wide frequency range, and can present an aesthetically appealing external effect.

7 Claims, 2 Drawing Sheets

(56) References Cited

FOREIGN PATENT DOCUMENTS

| | | | | |
|---|---|---|---|---|
| JP | 2004232262 | A | * | 8/2004 |
| KR | 10-0291214 | B1 | * | 3/2001 |
| KR | 20-0362414 | | * | 9/2004 |
| KR | 20-0362414 | Y1 | | 9/2004 |
| KR | 2006-126852 | A | * | 12/2006 |
| KR | 10-0792176 | B1 | | 12/2007 |
| KR | 803350 | B1 | * | 2/2008 |
| WO | WO 2010073274 | A1 | * | 7/2010 |

* cited by examiner

SOUND-ABSORBING NOISE BARRIER

This is a National Phase Application filed under 35 U.S.C. 371 as a national stage of PCT/KR2010/003623, filed on Jun. 7, 2010, an application claiming the benefit from Korean Application No. 10-2009-0055163 filed on Jun. 19, 2009, the entire content of each of which is hereby incorporated by reference in its entirety.

TECHNICAL FIELD

The present invention relates to a sound-absorbing noise barrier, and more particularly, to a sound-absorbing noise barrier which may be employed in various ways for construction and industrial products, exhibit good sound-absorbing characteristics in wide frequency ranges, and provide an aesthetically pleasing appearance.

BACKGROUND ART

In general, noise barriers are built on a road or railroad near a residential region, on various facilities generating severe noise, or in the vicinity of construction sites generating severe construction noise, and serve to block noise and vibration.

Noise barriers are typically classified into a sound-blocking type, a sound-absorbing type, and a resonance type according to functions thereof The sound-blocking noise barrier includes a transparent noise barrier made of polycarbonate or polyacrylics, a compression molding cement panel, a plastic panel, etc. The sound-absorbing noise barrier includes a metallic noise barrier made of aluminum and galvanized steel sheets, a wooden noise barrier using preserved wood, a lightweight concrete noise barrier, etc.

Among these noise barriers, the sound-absorbing noise barrier employs a porous material such as glass fiber, polyester (PET), and the like to have sound-absorbing effects. Such a porous sound-absorbing material has high sound-absorbing performance in a high frequency band, but exhibits negative sound-absorbing performance in a low frequency band. Further, the porous sound-absorbing material has a large thickness to achieve high sound-absorbing performance, and must be combined with another material for interior decoration.

Further, since polyester absorbs water, its surface is subjected to water-repellent finishing in preparation for rainy weather, but the water-repellent finishing has a problem of decreasing a sound-absorbing coefficient. Further, glass wool or Rockwool is coated with a film to prevent scattering or the like on the surface thereof, but the coated film decreases the sound-absorbing coefficient.

The metallic noise barrier is likely to be corroded and discolored due to exhaust fumes and rainwater. The wooden noise barrier generally employs preserved wood and thus can suffer from surface contamination, cracking or discoloring when used for a long period of time.

DISCLOSURE

Technical Problem

The present invention is directed to solving the problems as described above, and provides a sound-absorbing noise barrier which may be employed in various ways for construction and industrial products, exhibit good sound-absorbing characteristics in wide frequency ranges, and provide an aesthetically pleasing appearance.

Technical Solution

An aspect of the present invention provides a sound-absorbing noise barrier, which includes: a main body including a front surface and a rear surface, the main body extending in a horizontal direction and having a space defined between the front surface and the rear space; and a sound-absorbing material received in the space of the main body while being separated from the front surface and the rear surface, the sound-absorbing material being formed of a superfine fiber having a mass per unit area of 400 g/m$^2$ or more. Here, the front surface of the main body is formed with recesses and projections in a vertical direction and formed with a plurality of sound-absorbing holes.

Advantageous Effects

According to exemplary embodiments of the invention, the sound-absorbing noise barrier may be employed in various ways for construction and industrial products, exhibit good sound-absorbing characteristics in wide frequency ranges, and provide an aesthetically pleasing appearance.

In addition, the sound-absorbing noise barrier may be easily manufactured and constructed through extrusion-molding as a single body, has natural texture based on synthetic wood used as a material for the noise barrier, and may exhibit excellent water-proof and weather-proof characteristics.

BEST MODE

Figure 1:
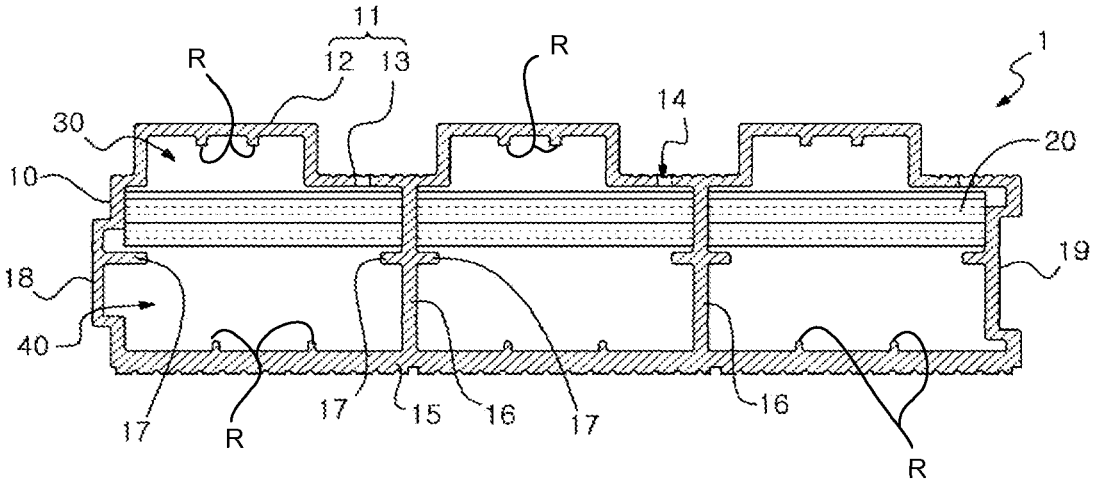
FIGS. 1 and 2 are cross-sectional views of a sound-absorbing noise barrier according to one exemplary embodiment of the present invention.

A sound-absorbing noise barrier according to exemplary embodiments of the present invention will now be described in detail with reference to the accompanying drawings. It should be understood that the present invention is not limited to the following embodiments and may be embodied in various ways. The scope of the invention is limited by the accompanying claims and equivalents thereof. Like elements will be indicated by like reference numerals throughout the specification.

Figure 2:
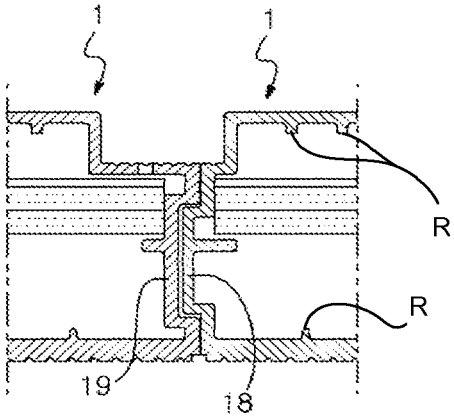
Figure 3:
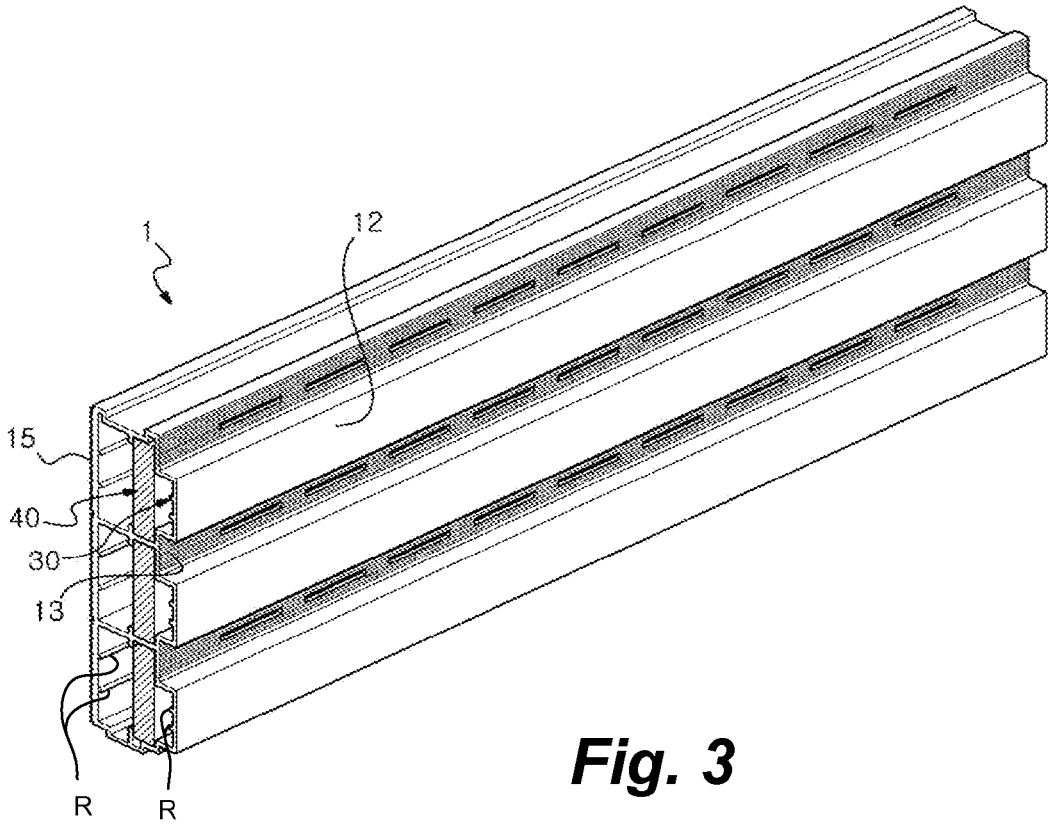
FIG. 3 is a perspective view of the sound-absorbing noise barrier according to the exemplary embodiment of the present invention.
Figure 4:
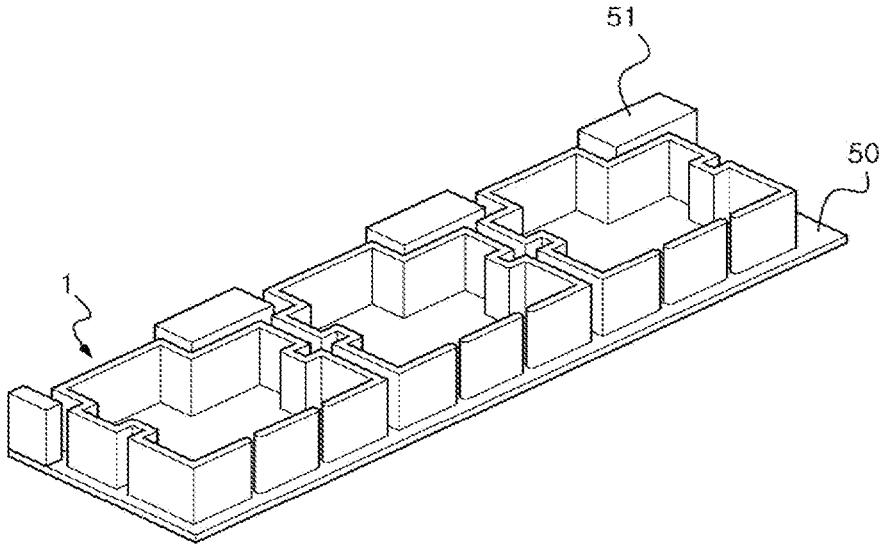
FIG. 4 is a cut-away perspective view of the sound-absorbing noise barrier according to the exemplary embodiment of the present invention.

FIGS. 1 and 2 are cross-sectional views of a sound-absorbing noise barrier according to one exemplary embodiment of the present invention; FIG. 3 is a perspective view of the sound-absorbing noise barrier according to the exemplary embodiment of the present invention; and FIG. 4 is a cut-away perspective view of the sound-absorbing noise barrier according to the exemplary embodiment of the present invention.

The sound-absorbing noise barrier 1 according to the exemplary embodiment includes a main body 10 and a sound-absorbing material 20 placed inside the main body 10.

The main body 10 has a front surface 11 and a rear surface 15, extends in a horizontal direction, and has space sections 30, 40 defined between the front surface and the rear surface.

The front surface 11 of the main body 10 is alternately formed with vertically oriented recesses 12 and projections 13, and is formed with a plurality of sound-absorbing holes 14. The main body 10 may be formed as a single body by extrusion-molding a mixed compound of olefin plastic resin and wooden flour. The front surface 11 of an undulating structure has a louver shape and the space sections 30, 40 serves to attenuate noise.

Each surface of the recesses 12 and the projections 13 may be formed with a plurality of uneven patterns, and thus diffused reflection occurs on the surface, thereby dissipating noise.

With respect to the sound-absorbing material 20, the space sections 30, 40 are divided into a first resonance section 30 defined between the sound-absorbing material 20 and the front surface 11 of the main body 10, and a second resonance section 40 defined between the sound-absorbing material 20 and the rear surface 15 of the main body 10. Noise introduced through the sound-absorbing holes 14 is first dissipated in the first resonance section 30, and is then absorbed and dissipated through the sound-absorbing material 20 and the second resonance section 40.

That is, the sound-absorbing holes 14 serve as a Helmholtz resonator, and the shape of the sound-absorbing hole 14 may be determined in consideration of sound-absorbing performance and an aesthetically pleasing appearance. For example, the sound-absorbing hole 14 may have, but is not limited to, a slit or a circular shape. Further, the diameter of the sound-absorbing hole 14 may be variously determined by taking sound-absorbing performance into account. To achieve high sound-absorbing performance, the overall cross-sectional area of the sound-absorbing holes 14 is at least 20% of the cross-sectional area of the front surface 11. If the overall cross-sectional area of the sound-absorbing holes 14 is smaller than this value, sound-absorbing performance is lowered. Here, although the overall cross-sectional area of the sound-absorbing holes 14 has no specific upper limit, the overall cross-sectional area of the sound-absorbing holes 14 may be set in the range from 30% to 40% in consideration of the aesthetically pleasing appearance.

The sound-absorbing material 20 may be formed of a material exhibiting good sound-absorbing or sound-blocking performance. For example, the sound-absorbing material 20 may be formed of one selected from the group consisting of polyurethane foam, polyurea foam, polyvinylchloride foam, polypropylene foam, polyethylene foam, polystyrene foam, polyvinylacetate foam, melanin foam, phenol foam, acryl foam, nonwoven fabrics, woven fabrics, glass wool, mineral wool and Rockwool, and a combination thereof, without being limited thereto, through lamination or bonding.

The sound-absorbing material 20 may be formed of a superfine fiber, which has a mass per unit area of 400 g/m$^2$ and is formed using an environmentally friendly olefin resin. Thus, the sound-absorbing material 20 may be thinly formed to a thickness of 20 to 30 mm (for example, about 26 mm), and thus the sound-absorbing noise barrier may become slim with a total thickness of 80 mm or less.

The main body 10 is formed with a partition wall 16 which divides the space sections 30, 40 into a plurality of regions. Further, holding guides 17 may protrude from the partition wall and the inner surface of the main body to allow the sound-absorbing material 20 to be arranged in a state of being separated from the front surface 11 and the rear surface 15 of the main body 10.

The second resonance section 40 defined between the sound-absorbing material 20 and the rear surface 15 of the main body 10 serves as a Helmholtz resonator, and is configured to exhibit sound-absorbing performance in a low frequency band. The current Korean Standards (KS), i.e. KSF 4770-3, regulates that an arithmetic mean of sound-absorbing coefficients at 250 Hz, 500 Hz, 1000 Hz and 2000 Hz be 0.7 or more. Accordingly, in the sound-absorbing noise barrier according to the exemplary embodiment, the second resonance section 40 may have a resonant structure in a frequency band of 500 Hz to 1000 Hz, and the sound-absorbing material 20 may be formed of a material having a high sound-absorbing coefficient in a band of 1000 Hz or more.

In the first resonance section 30, the frequency band for noise attenuation is determined depending on the area of the sound-absorbing holes 14 and the volume of the first resonance section 30. In the sound-absorbing noise barrier 1 according to the exemplary embodiment, a single sound-absorbing hole 14 is shared between two resonant structures 30, 40, thereby providing high sound-absorbing performance.

Also, each of the front surface 11 (particularly, the recesses 12) and the rear surface 15 of the main body 10 is formed with reinforcing protrusions R protruding inward. The reinforcing protrusions R provide structural stability to the sound-absorbing noise panel 10, and divide the first and second resonance sections 30, 40 into a plurality of spaces.

Referring to FIG. 2, the main body 10 of the sound-absorbing noise barrier 1 is formed at upper and lower ends thereof with a coupling projection 18 and a coupling groove 19 corresponding to the coupling projection 18, so that the sound-absorbing noise barriers 1 can be easily assembled to each other.

According to the exemplary embodiment, the sound-absorbing noise barrier 1 are open at opposite ends thereof in a longitudinal direction thereof since the main body 10 is a product of extrusion molding, so that noise introduced through the sound-absorbing holes 14 can be propagated to the outside through the open sides of the main body 10. To prevent propagation of noise, the sound-absorbing noise barrier 1 may further include side covers 50 mounted on opposite sides of the main body 10. Further, the side covers 50 may be formed with projections 51 for easy mounting.

For construction, the sound-absorbing noise barriers 1 with this configuration may be secured to a cement or concrete base, and may be stacked on one above another and inserted between H beams. Here, a coupling clip may be used to prevent the stacked sound-absorbing noise barriers 1 from separating from the H beams.

Although some embodiments have been provided to illustrate the present invention, it will be apparent to those skilled in the art that the embodiments are given by way of illustration only, and that various modifications, changes, and additions can be made without departing from the spirit and scope of the present invention. Therefore, the scope of the present invention should be limited only by the accompanying claims and equivalents thereof.

The invention claimed is:

1. A sound-absorbing noise barrier comprising:

a main body including a front surface and a rear surface, the main body extending in a horizontal direction and having a space defined between the front surface and the rear surface;

a sound-absorbing material received in the space of the main body and separated from the front surface and the rear surface and thereby separating the space of the main body into front and rear spaces, the sound-absorbing material being formed of a superfine fiber having a mass per unit area of 400 g/m$^2$ or more, the front surface of the main body being formed with recesses and projections in a vertical direction and formed with a plurality of sound-absorbing holes;

at least one partition wall dividing the space defined between the sound-absorbing material and the rear surface into a plurality of rear partition regions, with each of the rear partition regions forming a Helmholtz resonator; and the partition wall is formed with a holding guide protruding therefrom to support the sound-absorbing material.

2. The sound-absorbing noise barrier of claim 1, wherein an overall cross-sectional area of the sound-absorbing holes is at least 20% of a cross-sectional area of the front surface.

3. The sound-absorbing noise barrier of claim 1, wherein each of the front and rear surfaces of the main body is formed with a plurality of reinforcing protrusions protruding inward.

4. The sound-absorbing noise barrier of claim 1, wherein a resonance section is formed between the sound-absorbing material and the rear surface of the main body and has a resonant structure in a frequency band of 500 to 1000 Hz.

5. The sound-absorbing noise barrier of claim 1, wherein the sound-absorbing material comprises an olefin resin.

6. The sound-absorbing noise barrier of claim 1, wherein the sound-absorbing material has a thickness of 20 to 30 mm.

7. The sound-absorbing noise barrier of claim 1, wherein the main body is formed at upper and lower ends thereof with a coupling projection and a coupling groove corresponding to the coupling projection, respectively.

* * * * *